US008130252B2

(12) United States Patent
Fujikawa

(10) Patent No.: US 8,130,252 B2
(45) Date of Patent: Mar. 6, 2012

(54) OPTICAL HEAD, EXPOSURE APPARATUS AND IMAGE FORMING APPARATUS CAPABLE OF RESTRICTING NOISE

(75) Inventor: Shinsuke Fujikawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1175 days.

(21) Appl. No.: 11/873,665

(22) Filed: Oct. 17, 2007

(65) Prior Publication Data

US 2008/0106509 A1 May 8, 2008

(30) Foreign Application Priority Data

Nov. 2, 2006 (JP) ..... 2006-298561

(51) Int. Cl.
*B41J 2/435* (2006.01)

(52) U.S. Cl. ..... 347/237

(58) Field of Classification Search ..... 347/237; 345/89, 205; 257/72
See application file for complete search history.

(56) References Cited

U.S. PATENT DOCUMENTS 6,724,012 B2 * 4/2004 Kimura ..... 257/72
2009/0021501 A1 * 1/2009 Umezaki ..... 345/205

FOREIGN PATENT DOCUMENTS

JP A 2004-249549 9/2004

* cited by examiner

*Primary Examiner* — Stephen Meier
*Assistant Examiner* — Carlos A Martinez
(74) *Attorney, Agent, or Firm* — Oliff & Berridge, PLC

(57) ABSTRACT

An optical head expresses gray scales of pixels, which belong to a block constituted by n pixels and m pixels in a first and second direction, respectively. The optical head includes light emitting devices that extend in the first direction and emit light; driving transistors that are provided corresponding to the light emitting devices; a potential line that applies potential to the driving transistors; and driving circuits that are provided corresponding to the driving transistors and that supply a driving control signal to gates of the driving transistors. The driving circuits each include a line having an intersection at which the line intersects the potential line; and a logic circuit that generates the driving control signal based on image data to instruct the light emitting devices. The logic circuits invert logic levels of the lines at the intersections every n number of intersections extending in the first direction.

6 Claims, 13 Drawing Sheets

OPTICAL HEAD, EXPOSURE APPARATUS AND IMAGE FORMING APPARATUS CAPABLE OF RESTRICTING NOISE

BACKGROUND

1. Technical Field

The present invention relates to an optical head driven by an area ratio gray-scale method, an exposure apparatus, and an image forming apparatus using the exposure apparatus.

2. Related Art

An image forming apparatus such as a printer includes an optical head used to form an electrostatic latent image on an image carrier such as a photoconductive drum. The optical head includes a plurality of light emitting devices arranged in the form of an array in a main scanning direction. Light emitting diodes may be used as the light emitting devices.

An example of a method of representing gradation is an area ratio gray-scale method (for example, see JP-A-2004-249549). An area ratio gray-scale method represents gray scales in units of blocks by expressing pixels belonging to blocks, each of which is constituted by n pixels in a main scanning direction and m pixels in a sub scanning direction, with binary values.

In the optical head using the light emitting diodes in the related art, a semiconductor chip and a driving IC are mounted on a print substrate with patterned wire thereon. It is important to realize basic print shading in an actual printing operation. In an optical head integrated with a driving circuit, since a head width is reduced and accordingly a circuit layout is extremely high in density, various signal lines have to intersect power lines of light emitting diodes. This produces parasitic capacitance at intersections of the signal lines and the power lines. Since the parasitic capacitance acts as coupling capacitance, when a signal of a signal line is changed from turn-on to turn-off and vice versa, noise is superimposed on a power line. As a result, current flowing in light emitting diodes turned on is varied, thereby temporarily varying luminance. Even a minute change in luminance may have an effect on the formation of an electrostatic latent image on a photoconductive drum, which may cause a user to recognize unevenness on a print sheet.

This problem becomes serious in a so-called "solid coating" print. This is because several pixel circuits make the same logic shift simultaneously, and accordingly, larger noise is added to a power line in the solid coating print. For example, a head of an A3 sheet 600 dpi requires about 8000 pixels. In this case, although 8000 pixels are divided into blocks, several hundred pixel circuits have to operate simultaneously, which may result in a very high level of noise.

SUMMARY

An advantage of some aspects of the invention is to provide an optical head, an exposure apparatus and an image forming apparatus, which are capable of restricting noise.

According to an aspect of the invention, there is provided an optical head representing gray scales of an image by expressing gray scales of pixels, which belong to a block, with binary values, the block being constituted by n pixels (n is a natural number of 2 or more) in a first direction and m pixels (m is a natural number) in a second direction. The optical head includes: a plurality of light emitting devices that extend in the first direction and emit light with luminance in accordance with a driving current; a plurality of driving transistors that are provided corresponding to the plurality of light emitting devices and that supply the driving current; a potential line (for example, Lx shown in FIG. 4 and Lz shown in FIGS. 15A to 15D) that applies a source potential or a gate potential to the plurality of driving transistors; and a plurality of driving circuits that are provided corresponding to the plurality of driving transistors and that supply a driving control signal to specify an ON state or an OFF state for gates of the driving transistors. The driving circuits each include: a line (for example, Ly shown in FIG. 4) having an intersection at which the line intersects the potential line; and a logic circuit that generates the driving control signal based on image data to instruct turning-on or turning-off of the light emitting devices. The logic circuit of the plurality of driving circuits inverts a logic level of the line at the intersection every n natural number multiples extending in the first direction corresponding to the block.

Parasitic capacitance is produced at the intersection of the line and the potential line. Since the parasitic capacitance acts as coupling capacitance, when the logic level of the line is shifted, noise is superimposed on the potential line. The invention employs an area ratio gray-scale method for representing gray scales. In this case, a pattern of logic levels of the line has blocks as basic units. In addition, since the logic circuits of the plurality of driving circuits invert the logic levels of the lines at the intersection every n natural number of intersections extending in the first direction corresponding to the block, noises superimposed on the potential line can cancel each other out. As a result, print unevenness can be reduced, thereby significantly improving print quality.

The plurality of driving circuits may include a first driving circuit (for example, reference numeral 20A of FIG. 4) that inverts the image data an odd number of times until the image data reaches the intersection and a second driving circuit (for example, reference numeral 20B of FIG. 4) that inverts the image data an even number of times until the image data reaches the intersection. The first driving circuits and the second driving circuits may be alternately disposed every n natural number of intersections extending in the first direction corresponding to the block. In this case, since the logic levels at the intersections of the lines and the potential line are inverted in the first and second driving circuits, noises superimposed on the potential line can cancel each other out.

According to another aspect of the invention, there is provided an exposure apparatus including: an optical head according to the first aspect; and a control circuit that generates image data representing gray scales of an image by expressing gray scales of pixels belonging to the block with binary values, and outputs the generated image data to the optical head. With the second aspect of the invention, it is possible to suppress noise and reduce print unevenness.

According to still another aspect of the invention, there is provided an exposure apparatus including: an optical head including a plurality of light emitting devices extending in a first direction; and a control circuit that supplies image data to instruct turning-on or turning-off of the light emitting devices to the optical head. The control circuit generates the image data representing gray scales of an image by expressing gray scales of pixels, which belong to a block, with binary values, the block being constituted by n pixels (n is a natural number of 2 or more) in the first direction and m pixels (m is a natural number) in a second direction. The optical head includes: a plurality of driving transistors that supply a driving current to the plurality of light emitting devices; a potential line that supplies a source potential or a gate potential to the plurality of driving transistors; and a plurality of driving circuits that are provided corresponding to the plurality of driving transistors and that supply a driving control signal to specify an ON state or an OFF state for gates of the driving transistors. The driving circuits each include: a line having an intersection at which the line intersects the potential line; and a logic circuit that generates the driving control signal based on the image data. The control circuit generates the image data such that the logic circuits of the plurality of driving circuits invert logic levels of the lines at the intersections every n natural number of intersections extending in the first direction corresponding to the block.

According to still another aspect of the invention, since the control circuit generates the image data such that the logic circuits invert logic levels of the lines at the intersections every n natural number of intersections extending in the first direction corresponding to the block, it is possible to suppress noises superimposed on the potential line and reduce print unevenness.

The plurality of driving circuits each may include a first driving circuit (for example, reference numeral 20A of FIG. 12) and a second driving circuit (for example, reference numeral 20C of FIG. 12). The first driving circuit may include a latch circuit that latches the image data, a first inverting circuit that inverts an output signal of the latch circuit, and a second inverting circuit that inverts an output signal of the first inverting circuit and outputs the driving control signal, and the line having the intersection at which the line intersects the potential line connects an output terminal of the first inverting circuit and an input terminal of the second inverting circuit. The second driving circuit may include a latch circuit that latches the image data, and a first inverting circuit that inverts an output signal of the latch circuit and outputs the driving control signal, and the line having the intersection at which the line intersects the potential line connects an output terminal of the first inverting circuit and gates of the driving transistors. The first driving circuits and the second driving circuits may be alternately disposed every n natural number of intersections extending in the first direction corresponding to the block.

In this case, since the control circuits invert the image data, the second inverting circuit in the second driving circuit of the optical head may be omitted. As a result, it is possible to simplify the optical head, thereby making it possible to make the optical head smaller.

According to still another aspect of the invention, there is provided an image forming apparatus including: an exposure apparatus according to the second aspect; and an image carrier on which an image is formed by light emitted from the optical head. With this aspect, the effects of the above-described aspects can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
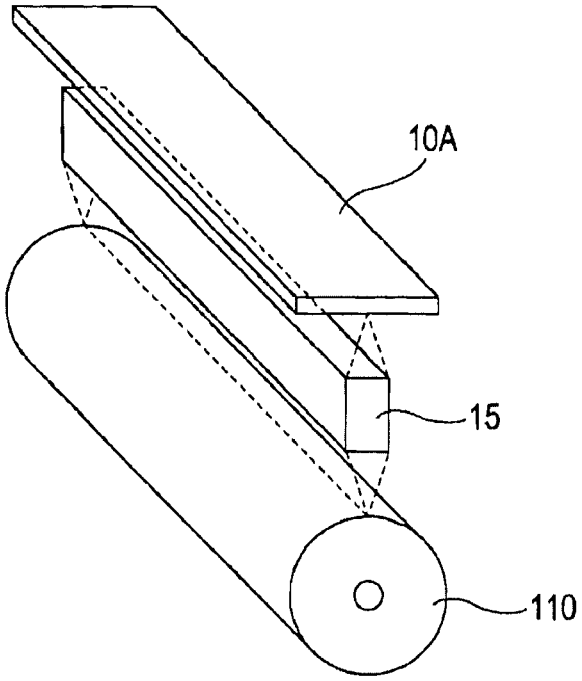
FIG. 1 is a perspective view showing a configuration of a portion of an image forming apparatus using an optical head according to a first embodiment of the invention.

Exemplary embodiments of the invention will be hereinafter described with reference to the accompanying drawings in which like elements are denoted by like reference numerals.

First Embodiment

FIG. 1 is a perspective view showing a configuration of a portion of an image forming apparatus using an optical head according to a first embodiment of the invention. As shown in FIG. 1, the image forming apparatus includes an optical head 10A, a condensing lens array 15 and a photoconductive drum (image carrier) 110. The optical head 10A includes a plurality of light emitting devices arranged in the form of an array. These light emitting devices emit light selectively depending on an image to be printed on a recording material such as a paper. A light emitting device may be any device as long as it can form an electrostatic latent image on the photoconductive drum 110. In the embodiment, for example, an OLED (organic light emitting diode) device may be used as the light emitting device. The condensing lens array 15 is interposed between the optical head 10A and the photoconductive drum 110. The condensing lens array 15 includes a plurality of gradient index lenses arranged in the form of an array, with their respective optical axes oriented toward the optical head 10A. The light emitted from the light emitting devices of the optical head 10A passes through the gradient index lenses of the condensing lens array 15 and is focused on a surface of the photoconductive drum 110. While the photoconductive drum 110 is rotated, an electrostatic latent image according to a desired image is formed at a predetermined exposure position on the surface of the photoconductive drum 110. In this embodiment, the optical head 10A include 8 k light emitting devices (k is a natural number) arranged in a main scanning direction (first direction).

Figure 2:
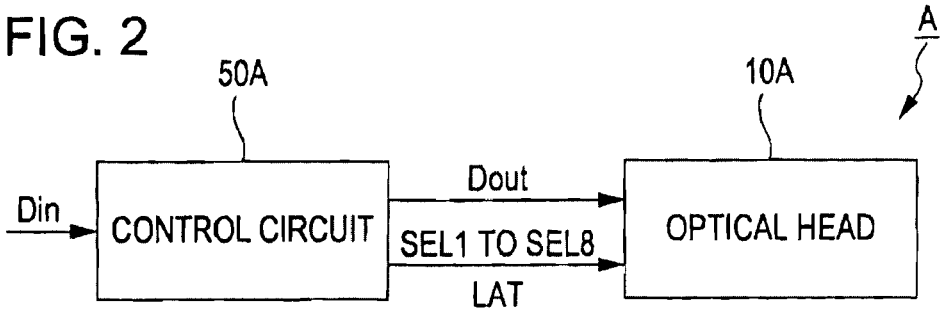
FIG. 2 is a block diagram showing a configuration of an exposure apparatus.
Figure 3:
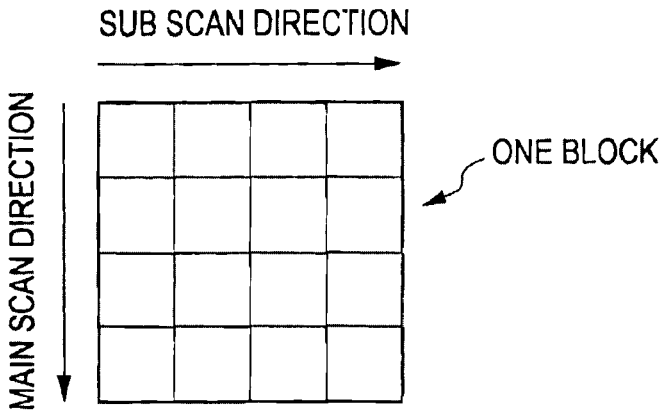
FIG. 3 is an explanatory view explaining blocks used in an area ratio gray-scale method.

FIG. 2 is a block diagram showing a configuration of an exposure apparatus A using the optical head 10A. As shown in FIG. 2, the exposure apparatus A includes a control circuit 50A and the optical head 10A. The control circuit 50A generates output image data Dout based on input image data Din supplied from an upper level apparatus. The output image data Dout is data instructing pixels to turn-on/off according to an area ratio gray-scale method. The control circuit 50A outputs various control signals for controlling the optical head 10A. In this embodiment, as shown in FIG. 3, one block is constituted by 4×4 pixels (4 pixels in the main scanning direction (first direction) and 4 pixels in a sub scanning direction (second direction)) and represents one gray scale.

Figure 4:
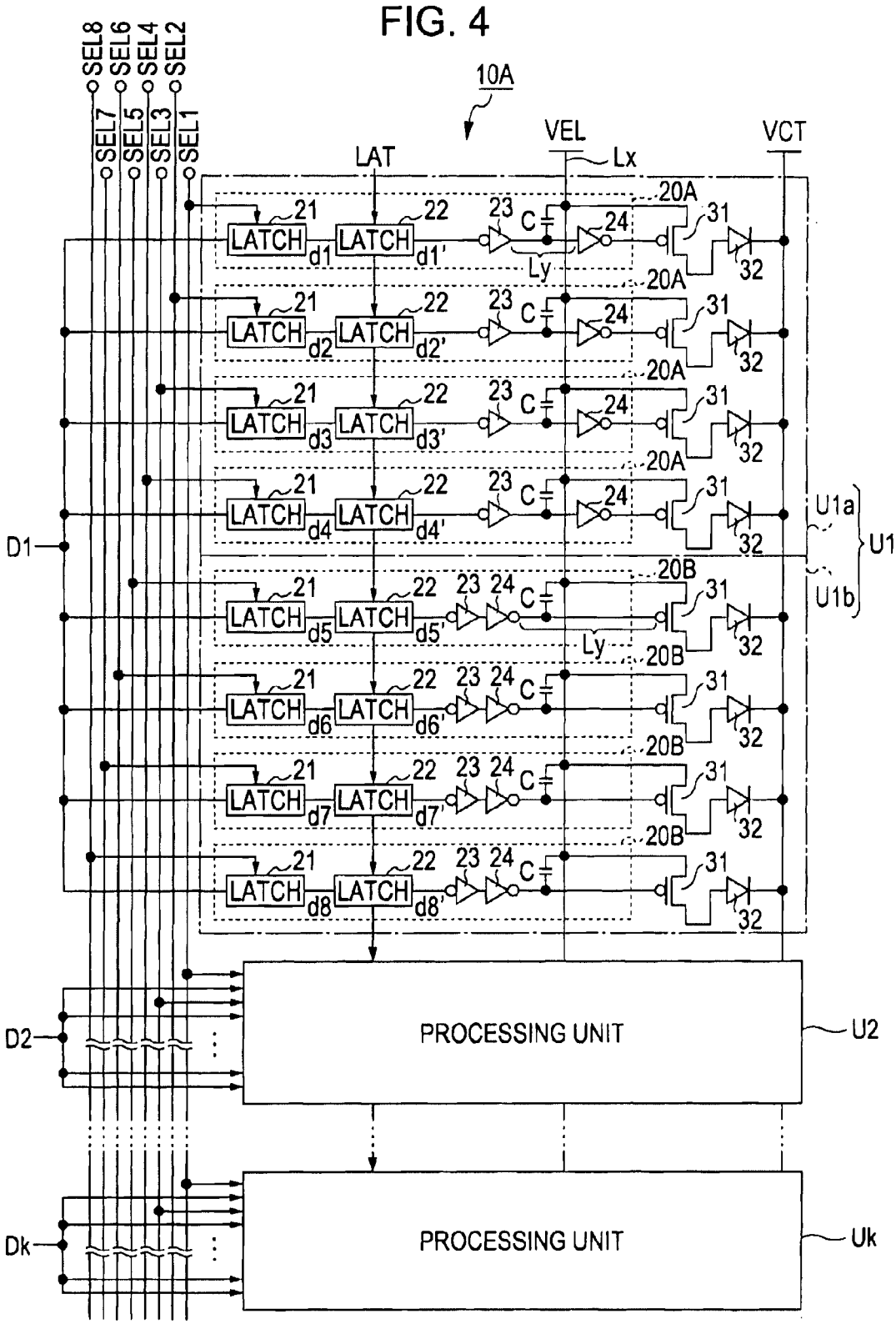
FIG. 4 is a circuit diagram showing a configuration of an optical head.

FIG. 4 shows a block diagram of the optical head 10A. The optical head 11A includes k processing units U1, U2, . . . , Uk (k is a natural number) to which image data D1, D2, . . . , Dk as the output image data Dout are respectively supplied. The image data D1 to Dk are respectively time-multiplexed into data d1, d2, . . . , d8 indicating turn-on/off of 8 light emitting devices. Selection signals SEL1 to SEL8 are signals that become of a high level exclusively during periods in which the data d1 to d8 become respectively validated.

Next, the processing unit U1 will be described. Other processing units U2 to Uk have the same structure as the processing unit U1. The processing unit U1 includes two block units U1*a* and U1*b*. Each of the block units U1*a* and U1*b* includes light emitting devices 32 of the same number as the number (4 in this embodiment) of pixels constituting the block in the main scanning direction.

The block unit U1*a* includes 4 light emitting devices 32, 4 driving transistors 31 and 4 driving circuits 20A. A potential VCT is supplied to cathodes of the light emitting devices 32, while their anodes are respectively electrically connected to drains of the driving transistors 31. Sources of the driving transistors 31 are electrically connected to a power line Lx. The power line Lx is supplied with a power potential WEL from a power supply circuit (not shown). In this embodiment, VEL is greater than VCT.

Figure 5:
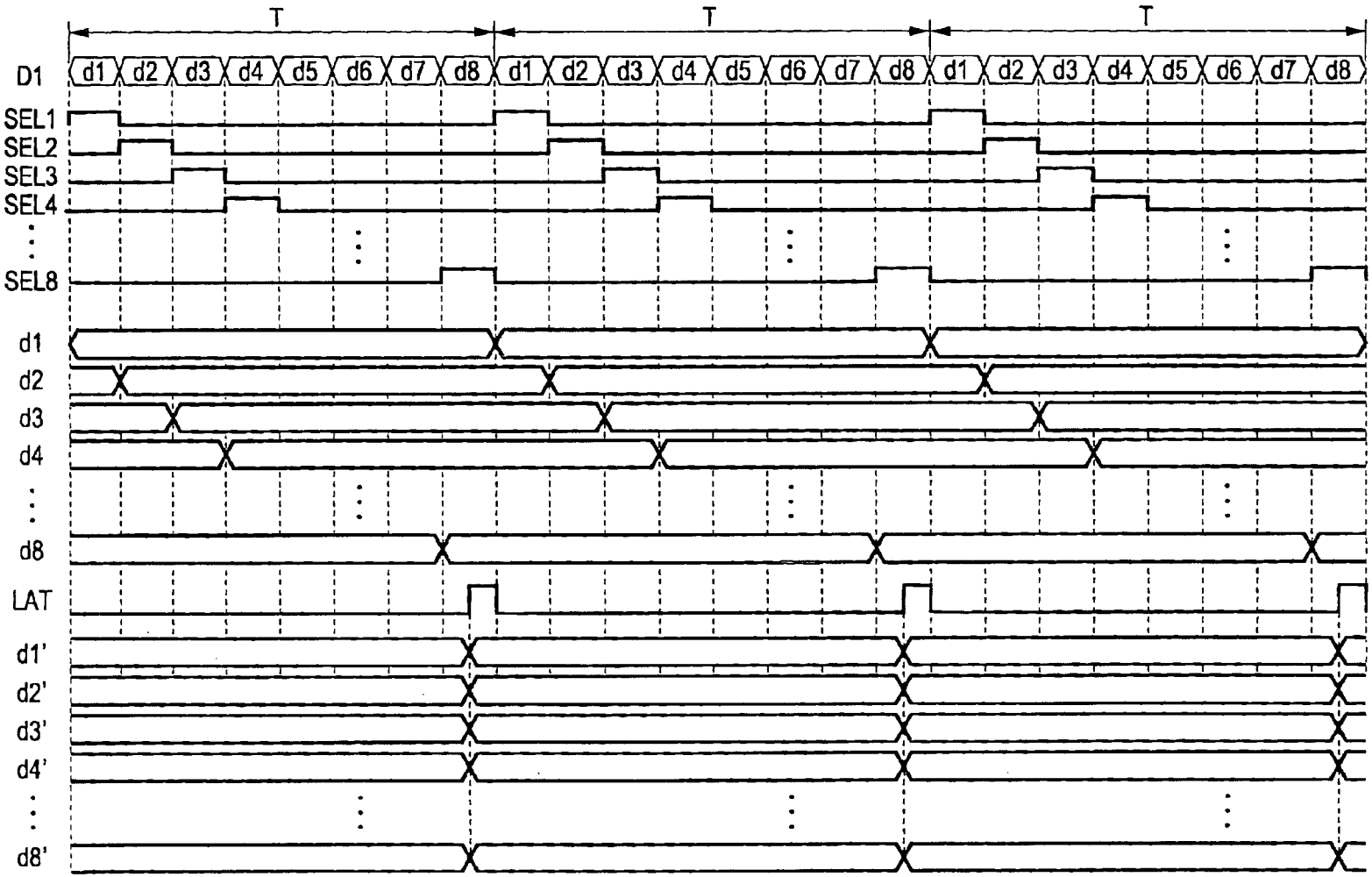
FIG. 5 is a timing chart showing an operation of a processing unit.

The driving circuits 20A include first latch circuits 21, second latch circuits 22 and inverters 23 and 24. These circuits function as logic circuits for applying gate potential to the driving transistors 31. This is equally applied to driving circuits 20B of the block unit U1*b*. The selection signals SEL1 to SEL8 are signals that become active sequentially during a predetermined period T, as shown in FIG. 5. Accordingly, the output signals d1 to d8 of the first latch circuits 21 are in synchronization with the selection signals SEL1 to SEL8. The second latch circuits 22 latch the output signals d1 to d8 of the first latch circuits 21 based on a latch signal LAT and generate output signals d1' to d8', respectively.

The driving circuits 20A of the block unit U1*a* and the driving circuits 20B of the block unit U1*b* are the opposite of each other in terms of logic levels of signals supplied to lines Ly intersecting the power line Lx. That is, output signals of the inverters 23 are supplied to the lines Ly in the driving circuits 20A while output signals of the inverters 24 are supplied to the lines Ly in the driving circuits 20B. In other words, the driving circuits 20A invert a logic level of image data an odd number of times until the image data reaches intersections of the lines Ly and the power line Lx while the driving circuits 20B invert a logic level of image data an even number of times until the image data reaches the intersections.

Parasitic capacitance C is generated in the intersections of the power line Lx and the lines Ly. Since the parasitic capacitance C acts as coupling capacitance, noise is superposed on the power line Lx in synchronization with the inverted logic level of the signal supplied the lines Ly. Here, luminance of the light emitting devices 32 depends on driving current flowing therein. Accordingly, when the noise is superimposed on the power line Lx through the parasitic capacitance C, the driving current is varied, thereby varying the luminance of the light emitting devices 32. In this embodiment, the reason for the inversion of the logic level of the signals supplied to the lines Ly intersecting the power line Lx in the driving circuits 20A and 20B in the block units U1*a* and U1*b* is to cancel the noises superimposed on the power line Lx.

Figure 6:
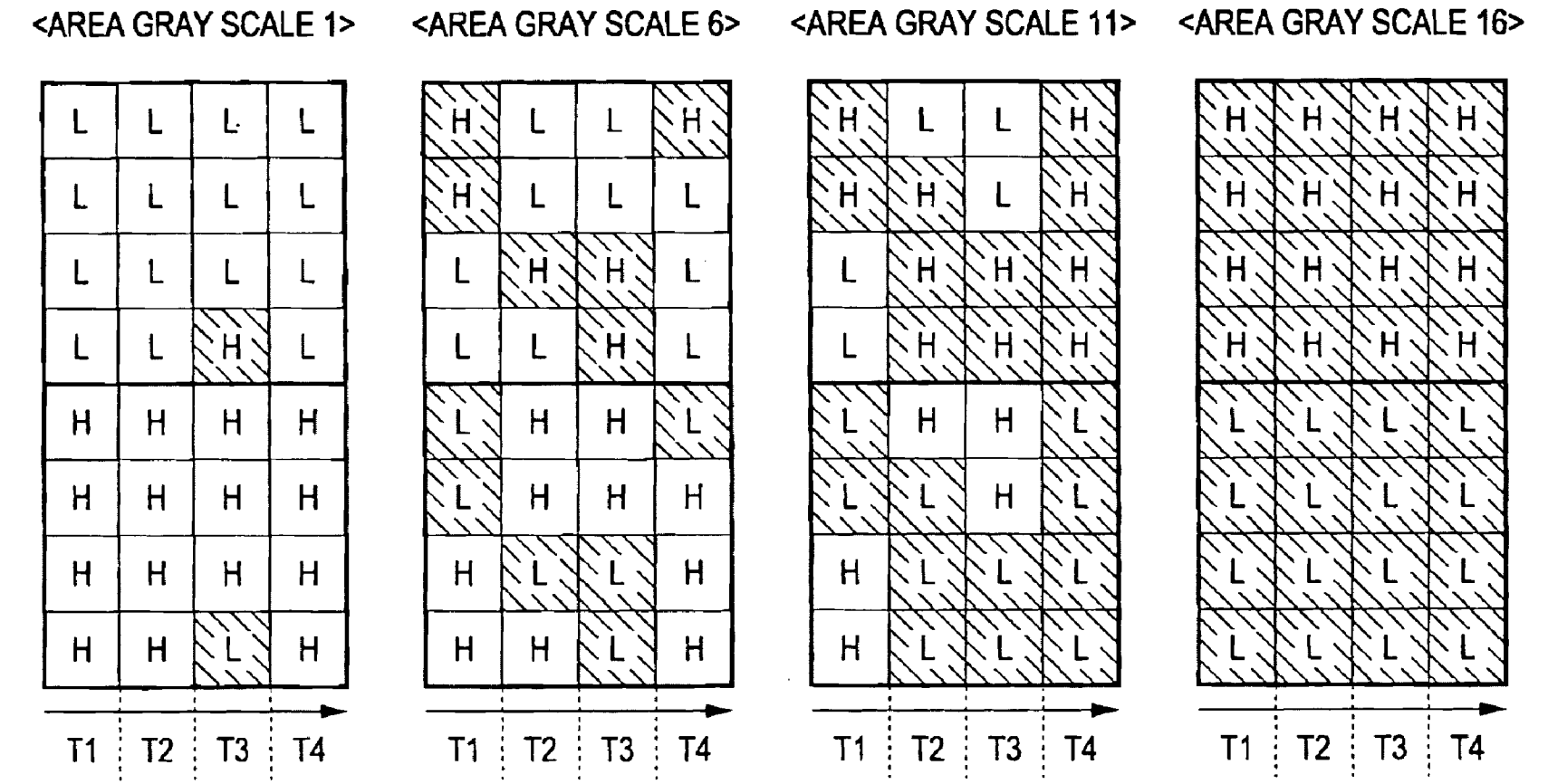
FIG. 6 is an explanatory view explaining a relationship between an area gray scale and a logic level of a line.

FIG. 6 is an explanatory view explaining a relationship between an area gray scale and logic levels of the lines Ly in the intersections. In this figure, shaded portions represent pixels turned on by the light emitting devices 32. As shown in this figure, one pixel in each block is turned on for area ratio gray scale 1, while 6pixels in each block are turned on for area ratio gray scale 6. Here, for area ratio gray scale 1, during a period T2, all logic levels of the lines Ly of the block unit U1*a* are "L", while all logic levels of the lines Ly of the block unit U1*b* are "H". During a period T3, one logic level of the lines Ly of the block unit U1*a* is shifted from "L" to "H", while one logic level of the lines Ly of the block unit U1*b* is shifted from "H" to "L". That is, in this embodiment, since the driving circuits 20A and 20B are configured in such a manner that the logic levels of the lines Ly are inverted in the units of blocks, the number of shifts of the logic levels of the lines Ly (logic levels of the intersections) from "L" to "H" becomes equal to the number of shifts of the logic levels of the lines Ly from "H" to "L". For example, for area ratio gray scale 11, when the period T1 is shifted to the period T2, the number of shifts of the logic levels from "L" to "H" is 3, while the number of shifts of the logic levels from "H" to "L" is also 3.

Figure 7A:
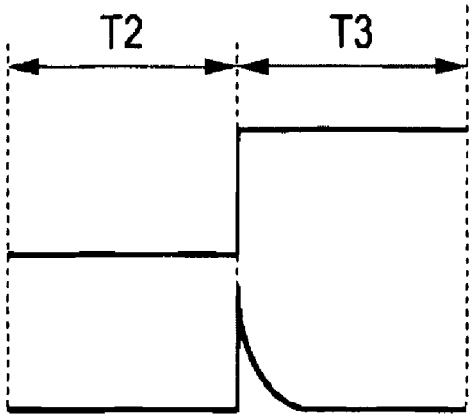
FIGS. 7A and 7B are waveform diagrams showing a waveform of noise.
Figure 7B:
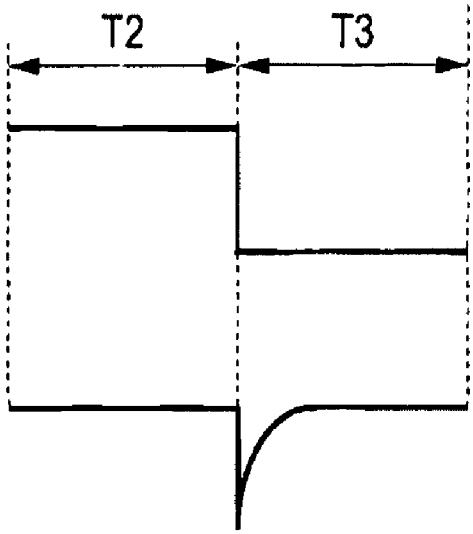

When the logic levels of the line Ly are shifted from "L" to "H", pulse-shaped noise of positive polarity is generated as shown in FIG. 7A, and, when the logic levels of the line Ly are shifted from "H" to "L", pulse-shaped noise of negative polarity is generated as shown in FIG. 7B. These noises cancel each other out on the power line Lx, which suppresses generation of noise.

Figure 8:
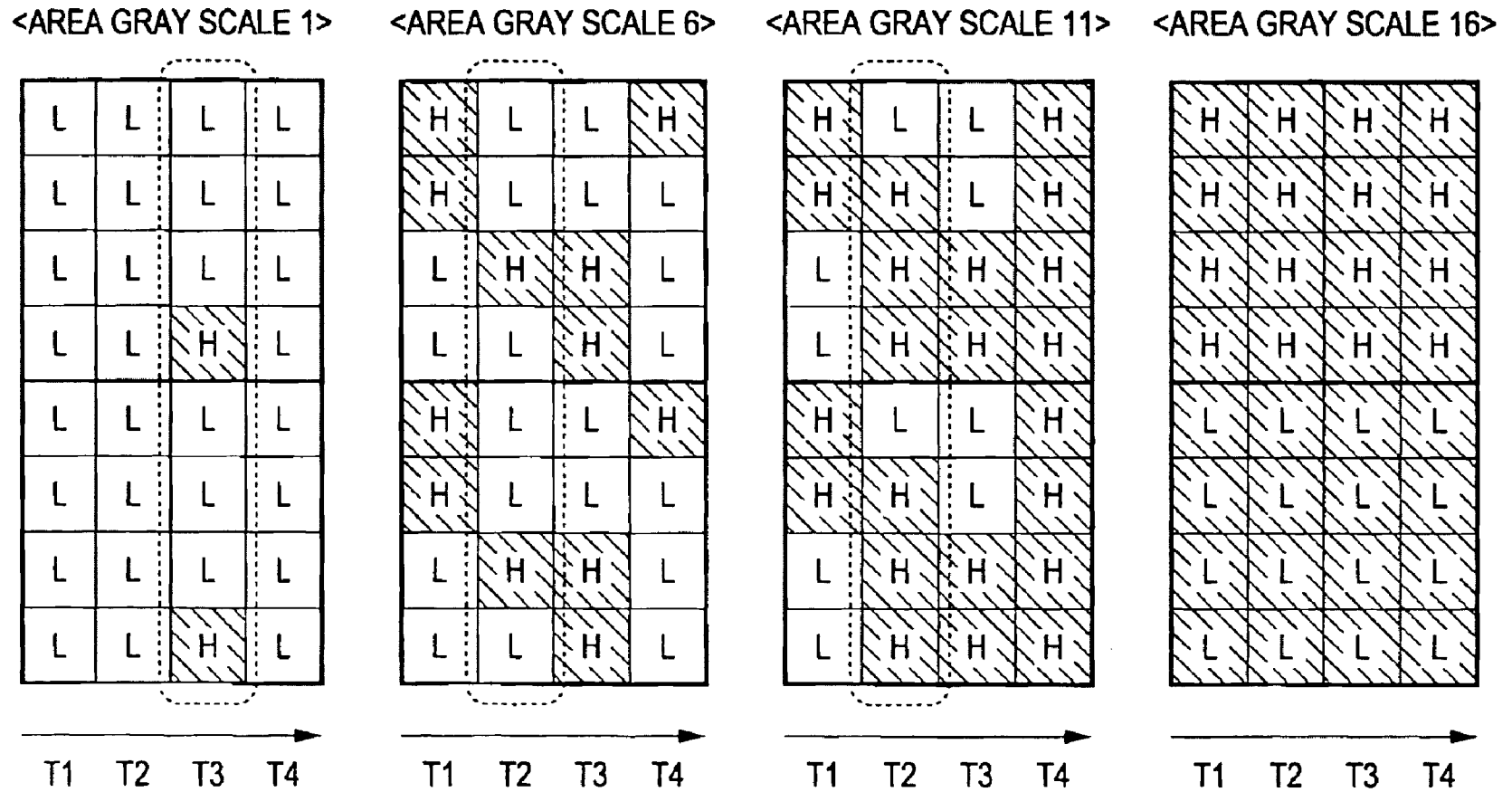
FIG. 8 is an explanatory view explaining a relationship between an area gray scale and a logic level of a line in a comparative example.

If the block unit U1*b* is constituted by the same driving circuit 20A as in the block unit U1*a*, a relationship between the logic levels of the lines Ly at the intersections and the area ratio gray scale is as shown in FIG. 8. In this case, an imbalance occurs between the logic levels of the lines Ly at portions enclosed by dotted lines. For example, during a period T2 of area ratio gray scale 6, "L" becomes "6", and "H" becomes "2". With such an imbalance, the number of shifts of the logic levels from "L" to "H" becomes unequal to the number of shifts of the logic levels from "H" to "L", thereby increasing noise superimposed on the power line Lx.

In this manner, since the optical head 10A according to this embodiment can suppress the noise superimposed on the power line Lx, when gray scales are represented by the area ratio gray-scale method, luminance unevenness is reduced, which may result in significant improvement in print quality.

Figure 9:
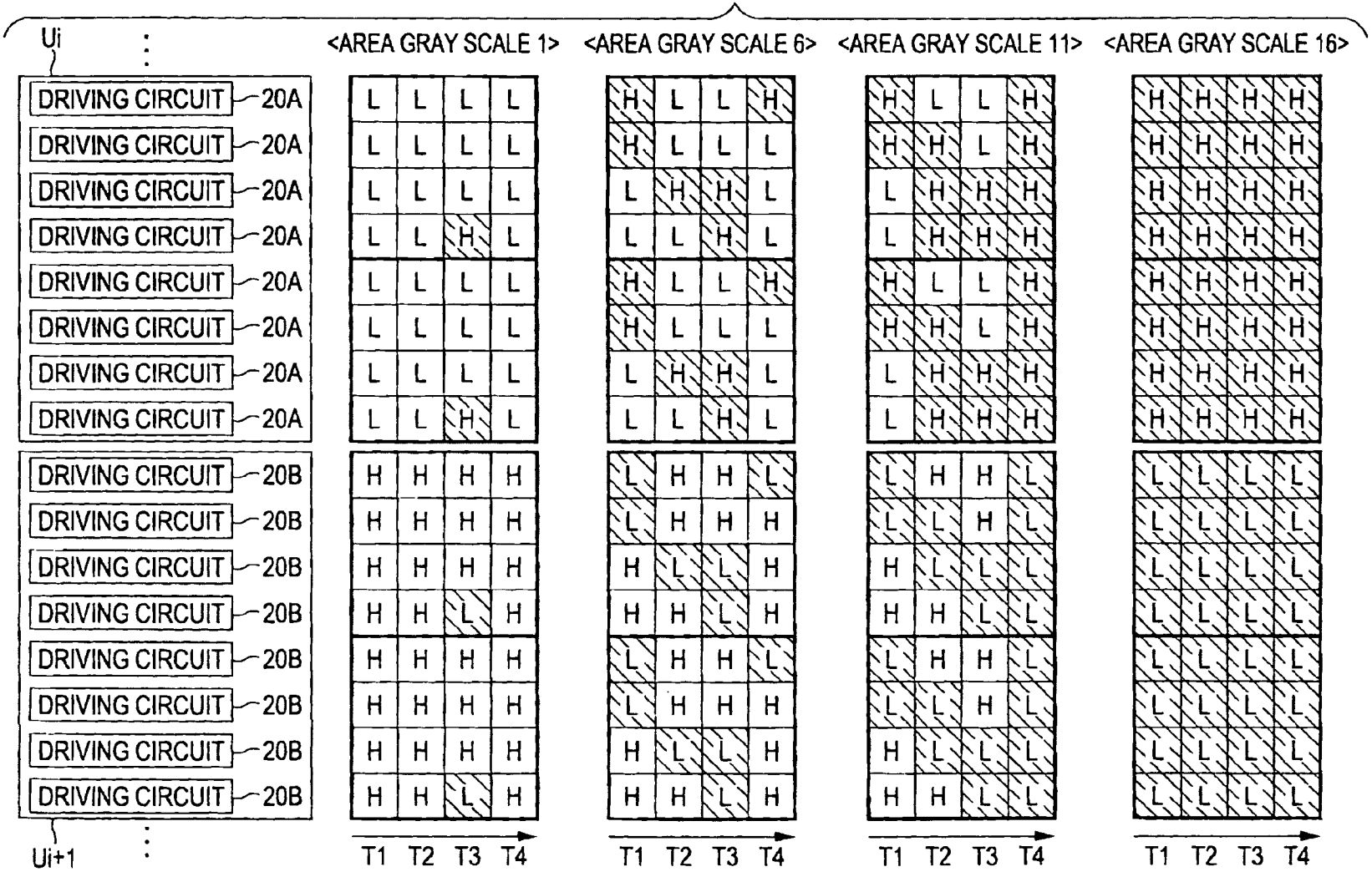
FIG. 9 is an explanatory view explaining another configuration of the processing unit and a relationship between an area gray scale and a logic level of a line.

In the above-described embodiment, the noise superimposed on the power line Lx is reduced by inverting the logic levels of the lines Ly in the unit of block. This is because noises cancel each other out by making the number of shifts of the logic levels from "H" to "L" equal to the number of shifts of the logic levels from "L" to "H". When gray scales are represented by the area ratio gray-scale method, a pattern of logic levels of the lines Ly (combination of the logic levels) has blocks as basic units. From the standpoint of suppression of noise, noises may be cancelled out in any unit. Accordingly, a driving circuit may be configured in such a manner that the logic levels of the lines Ly are inverted for natural number multiples of blocks. Here, if each of the blocks includes n pixels (n is a natural number of 2 or more) in the main scanning direction (first direction) and m pixels (m is a natural number of 2 or more) in the sub-scanning direction (second direction), logic circuits of a plurality of driving circuits may be those that invert the logic levels of the signals applied to the lines Ly every n natural number of intersections extending in the main scanning direction corresponding to the blocks. For example, as shown in FIG. 9, the driving circuits 20A and the driving circuits 20B may be arranged by the unit of two blocks. In this case, noises cancel each other out by the unit of four blocks.

Second Embodiment

Figure 10:
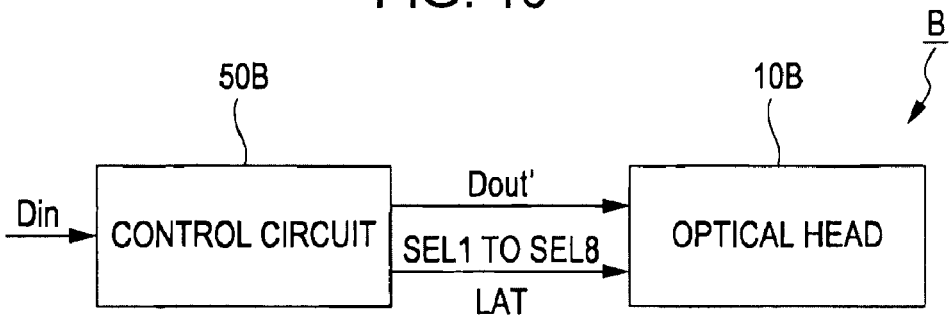
FIG. 10 is a block diagram showing a configuration of an exposure apparatus according to a second embodiment of the invention.
Figure 11:
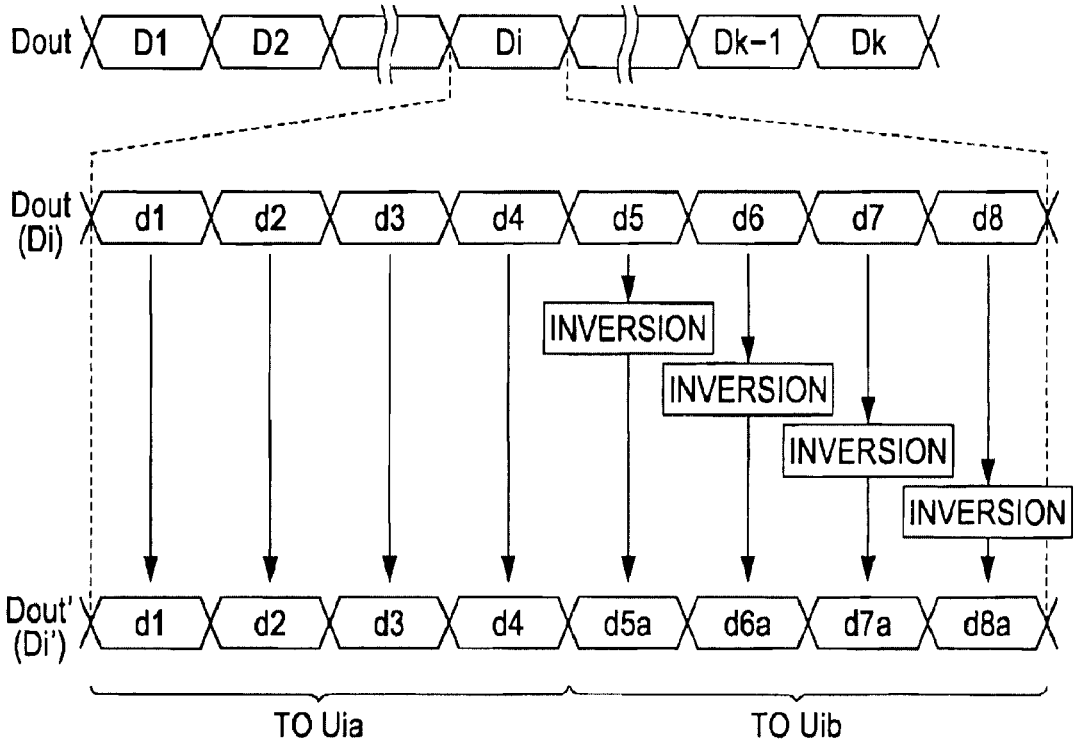
FIG. 11 is a timing chart showing an operation of a control circuit.

FIG. 10 is a block diagram showing an exposure apparatus B according to a second embodiment of the invention. In the above-described first embodiment, the configuration to invert the logic levels of the lines Ly by the block is completed within the optical head 10A. On the other hand, the exposure apparatus B according to the second embodiment generates output image data Dout' whose logic levels are inverted in the unit of block in a control circuit 50B. More specifically, as shown in FIG. 11, among d1, d2, d3, d4, . . . , d8 that constitute i-th image data ($1 \leqq i \leqq k$) in the output image data Dout of the first embodiment, the control circuit 50B inverts d5 to dB to generate the output image data Dout'. d1 to d4 that constitute image data Di' are supplied to a block unit Uia corresponding to (2i-1)-th block, and d5*a* to d8*a* that constitute the image data Di' are supplied to a block unit Uib corresponding to 2i-th block. Since d1 to d4 and d5*a* to d8*a* are data in the unit of block, the logic levels of the output image data Dout' supplied to the optical head 10B are inverted in the unit of block. In this case, d1 to d4 instruct turning-on of the light emitting devices 32 in "0" and instruct turning-off of the light emitting devices 32 in "1." On the other hand, d5*a* to d8*a* instruct turning-on of the light emitting devices 32 in "1" and instruct turning-off of the light emitting devices 32 in "0".

Figure 12:
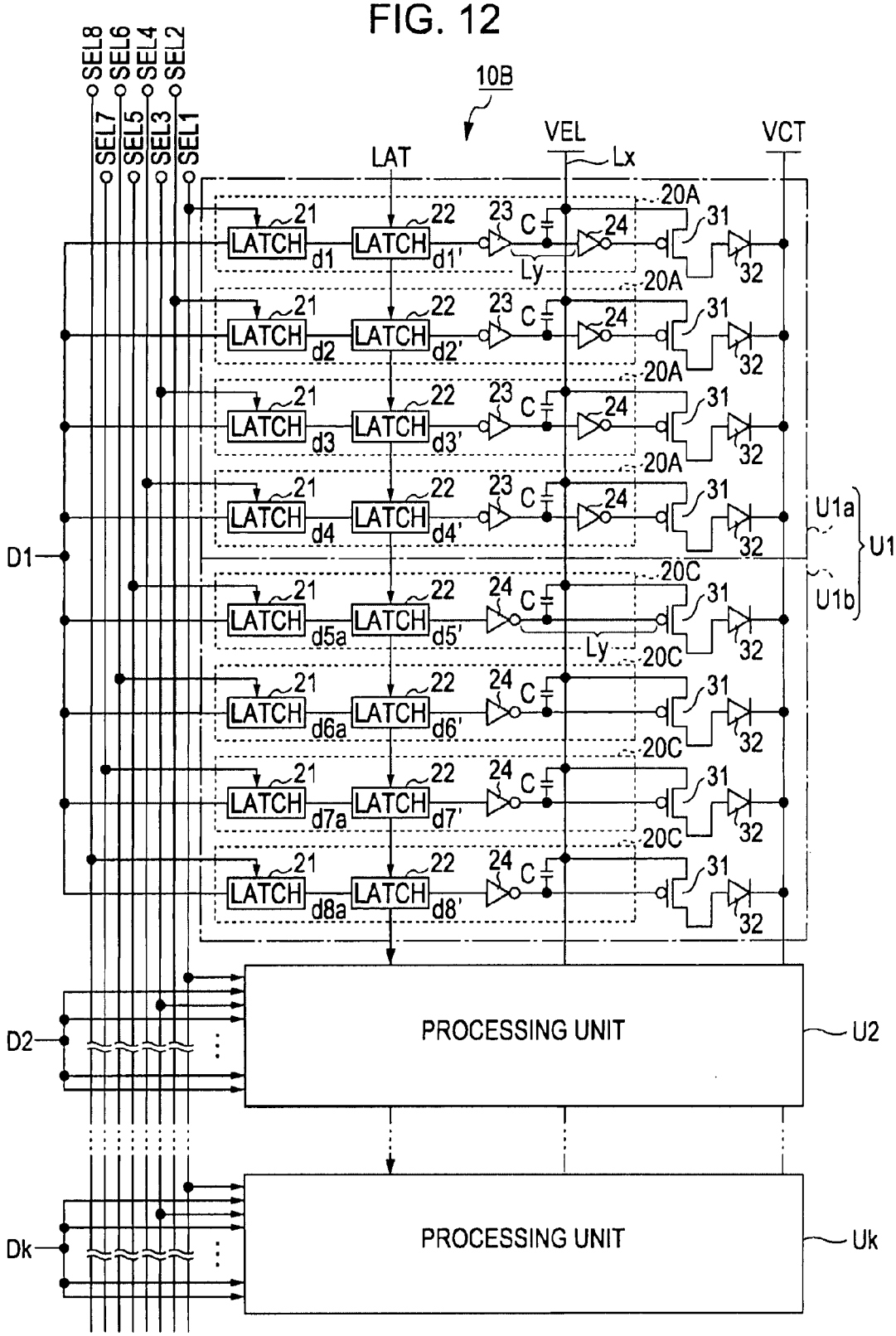
FIG. 12 is a circuit diagram showing a configuration of an optical head.

FIG. 12 is a circuit diagram showing an optical head 10B according to the second embodiment. The optical head 10B has the same structure as the optical head 10A of the first embodiment shown in FIG. 4 except that the former uses driving circuits 20C instead of the driving circuits 20B that constitute the block unit U1*b*. The driving circuits 20C have the configuration in which the inverters 23 are excluded from the driving circuits 20B. Since the logic levels of d5*a* to d8*a* are the inversion of the logic levels of d1 to d4 as described above, the driving circuits 20C can invert the logic levels of the lines Ly without the inverters 23. This makes a relationship between the logic levels of the lines Ly at the intersections and the area ratio gray-scale equal to the relationship in the first embodiment shown in FIG. 6.

According to the second embodiment, since the control circuit 50B determines whether or not the logic levels are alternately inverted in the unit of block, it is possible to simplifying the configuration of the optical head 10B and suppress superimposition of noise on the power line Lx, thereby significantly improving print quality.

Alternatively, the control circuit 50B may determine whether or not the logic levels are alternately inverted in the unit of natural number multiple of blocks. In this case, the driving circuits 20C may be used in correspondence to the inversion of the logic levels. Here, if each of blocks includes n pixels (n is a natural number of 2 or more) in the main scanning direction (first direction) and m pixels (m is a natural number of 2 or more) in the sub scanning direction (second direction), the control circuit 50B may generate the output image data Dout' in such a manner that the logic levels of the line Ly are inverted every n natural number multiples extending in the main scanning direction corresponding to the blocks.

Figure 13:
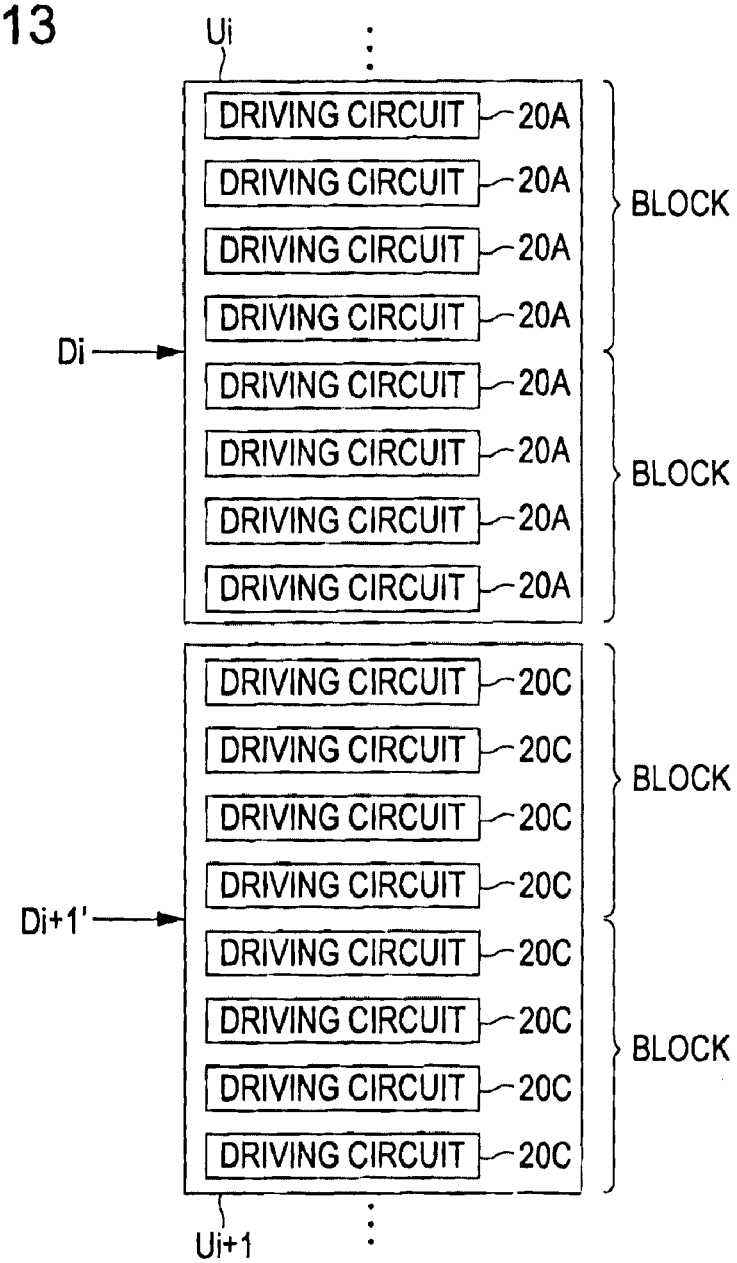
FIG. 13 is a block diagram showing another configuration of a processing unit.
Figure 14:
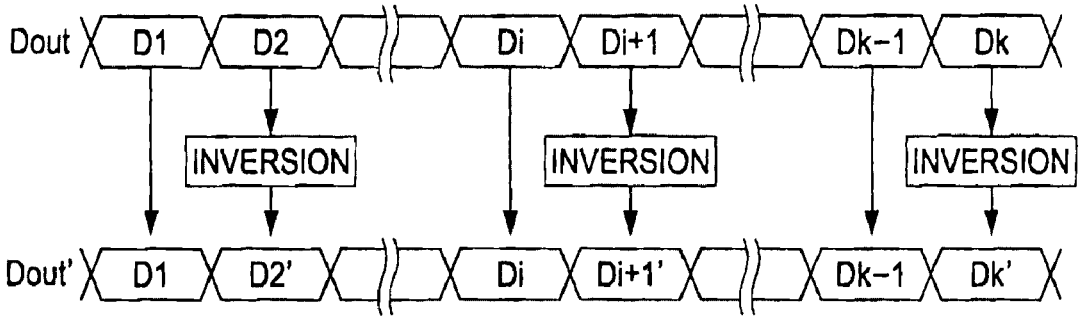
FIG. 14 is a timing chart showing an operation of a control circuit.

For example, if the driving circuits 20A and the driving circuits 20C may be arranged by the two blocks as shown in FIG. 13, the control circuit 50B may invert the logic levels by the two blocks to generate the output image data Dout', as shown in FIG. 14. In this case, a relationship between the area ratio gray scale and the logic level of the lines Ly becomes equal to the relationship shown in FIG. 9.

Modification

Although the above-described embodiments make an issue of parasitic capacitance at the intersections of the power line Lx and the lines Ly, the luminance of the light emitting devices 32 may depend on the gate potential of the driving transistors 31. Accordingly, if there is provided a potential line Lz for applying the gate potential when the driving transistors 31 are turned on, parasitic capacitance at intersections of the potential line Lz and the lines Ly may be also problematic.

Figure 15A:
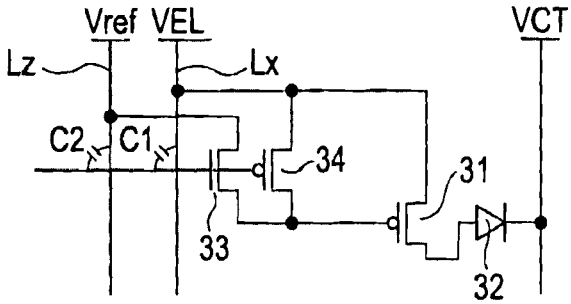
FIGS. 15A to 15D are circuit diagrams showing a configuration of a driving circuit according to a modification of the invention.

For example, it is assumed that a light emitting device 32 is driven with a circuit configuration shown in FIG. 15A. In this example, when the light emitting device 32 is turned on, a transistor 31 is turned on, and accordingly, a reference potential Vref is supplied to a gate of the transistor 31 through the potential line Lz, and a transistor 34 is turned off. On the other hand, when the light emitting device 32 is turned off, a transistor 33 is turned off and the transistor 34 is turned on, and accordingly, a power potential VEL is supplied to the gate of the transistor 31. In addition, as shown in FIG. 15B, assuming that powers to drive latch circuits 21 and 22 and inverters 23 and 24 are VDD and VSS, respectively, a relationship of $VDD \geqq VEL \geqq Vref \geqq VSS$ is set.

With this configuration, there exists parasitic capacitance C1 between the lines Ly and the power line Lx, and there exists parasitic capacitance C2 between the lines Ly and the potential line Lz. Accordingly, if the logic levels of the lines Ly are changed, noise are superimposed on not only the power line Lx but also the potential line Lz. Therefore, the cancellation of noises on the power line Lx as described in the above embodiments may be equally applied to the potential line Lz.

Figure 15B:
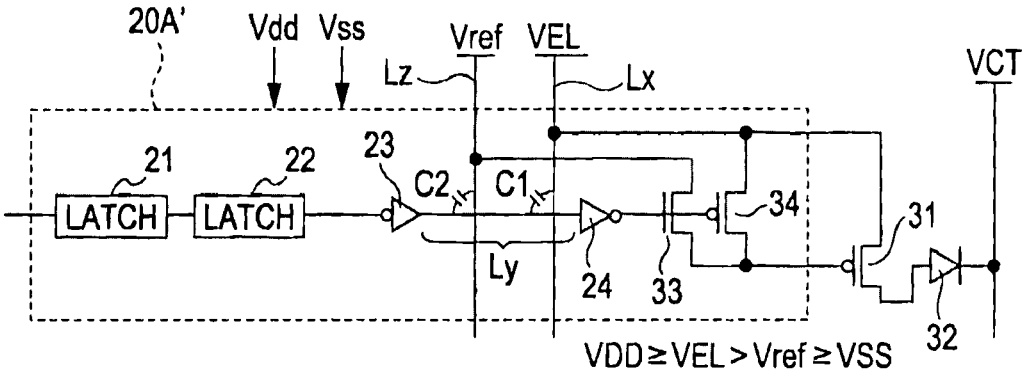
Figure 15C:
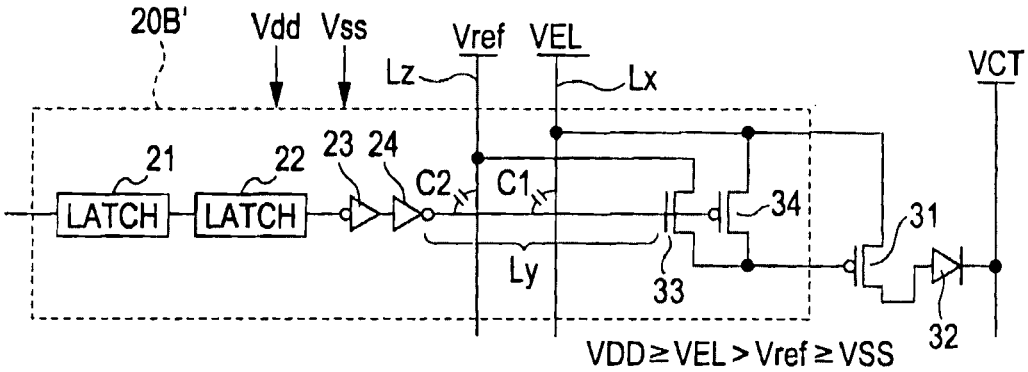
Figure 15D:
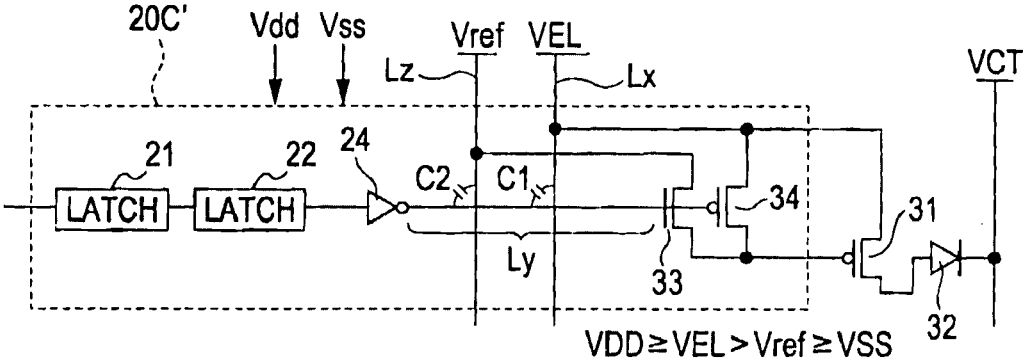

In more detail, driving circuits 20A' 20B' and 20C' shown in FIGS. 15B, 15C and 15D, respectively, may be employed instead of the driving circuits 20A, 20B and 20C described in the above embodiments, respectively.

Image Forming Apparatus

Figure 16:
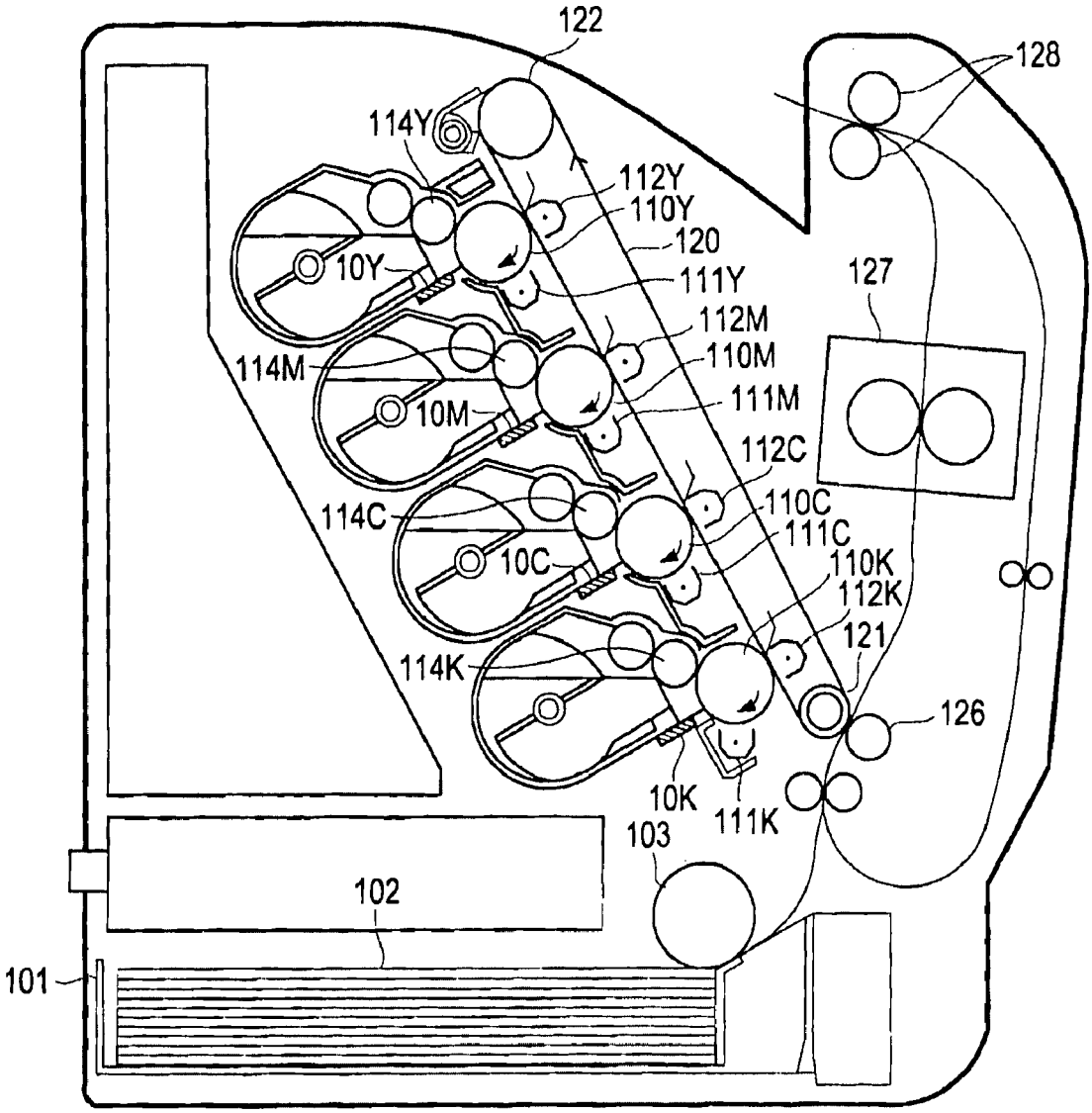
FIG. 16 is a longitudinal sectional view showing a configuration of an image forming apparatus using the optical head according to an embodiment of the invention.

The optical heads 10A and 10B according to the above-described embodiments and modification may be used as a line type optical head for forming an electrostatic latent image on an image carrier in an electrophotography-based image forming apparatus. An example of the image forming apparatus may include a printer, a printing unit of a copy machine, a printing unit of a facsimile machine, etc. FIG. 16 is a longitudinal sectional view showing an example of an image forming apparatus using the optical head 10A or 10B as a line type optical head. The shown image forming apparatus is a tandem type full color image forming apparatus using a belt intermediate transfer body system.

In this image forming apparatus, an array of 4 organic EL devices 10K, 10C, 10M and 10Y having the same structure are disposed at exposure positions of 4 photoconductive drums (image carriers) 110K, 110C, 110M and 110Y having the same structure, respectively. The array of organic EL devices 10K, 10C, 10M and 10Y corresponds to the optical head 10A or 10B according to the above-described embodiments and modification.

As shown in FIG. 16, this image forming apparatus is provided with a driving roller 121 and a driven roller 122. An endless intermediate transfer belt 120 is wound on these rollers 121 and 122 and is revolved around the rollers 121 and 122 as indicated by an arrow. Although not shown, there may be provided a tension roller or the like for granting tension to the intermediate transfer belt 120.

The four photoconductive drums 110K, 110C, 110M and 110Y having photosensitive layers formed on their respective circumference are disposed with a predetermined interval therebetween around the intermediate transfer belt 120. Suffixes K, C, M and Y are used to mean black, cyan, magenta and yellow development, respectively. This is true of other members. The photoconductive drums 110K, 110C, 110M and 110Y are rotated in synchronization with the driving of the intermediate transfer belt 120.

Corona chargers 111K, 111C, 111M and 111Y, the organic EL devices 10K, 10C, 10M and 10Y, and developing devices 114K, 114C, 114M and 114Y are disposed around the photoconductive drums 110K, 110C, 110M and 110Y, respectively. The corona chargers 111K, 111C, 111M and 111Y charge circumferences of respective photoconductive drums 110K, 110C, 110M and 110Y uniformly. The organic EL devices 10K, 10C, 10M and 10Y form electrostatic latent images on the charged circumference of the respective photoconductive drums. The organic EL devices 10K, 10C, 10M and 10Y are installed such that an arrangement direction of a plurality of light emitting devices P lies along a parent line (main scanning direction) of the respective photoconductive drums 110K, 110C, 110M and 110Y. The electrostatic latent images are formed by irradiating the photoconductive drums with light emitted from the plurality of light emitting devices P. The developing devices 114K, 114C, 114M and 114Y develop the photoconductive drums (that is, form visible images) by attaching toner as developer to the electrostatic latent images.

Developments of black, cyan, magenta and yellow images formed by 4 monochromatic development formation stations are primarily transferred into the intermediate transfer belt 120 sequentially and thus are superimposed on the intermediate transfer belt 120, thereby obtaining a full color development. Four primary transfer corotrons (transcribers) 112K, 112C, 112M and 112Y are disposed at an inner side of the intermediate transfer belt 120. The primary transfer corotrons 112K, 112C, 112M and 112Y are disposed near the photoconductive drums 110K, 110C, 110M and 110Y, respectively, and transfer the developments into the intermediate transfer belt 120 passing between the photoconductor drums and the primary transfer corotrons by electrostatically absorbing the developments from the photoconductive drums 110K, 110C, 110M and 110Y.

Sheets 102 as objects on which images are finally formed are fed one by one from a sheet supply cassette 101 by means of a pickup roller 103 and is sent to a nip between the intermediate transfer belt 120 contacting the driving roller 121 and a secondary transfer roller 126. Full color development on the intermediate transfer belt 120 is collectively secondary transferred into one side of the sheet 102 by means of the secondary transfer roller 126 and is fixed on the sheet 102 when the sheet 102 passes through a pair of fixing rollers 127 as a fixing unit. Thereafter, the sheet 102 is discharged to a sheet discharge cassette formed on an upper side of the apparatus.

Next, an image forming apparatus according to another embodiment of the invention will be described.

Figure 17:
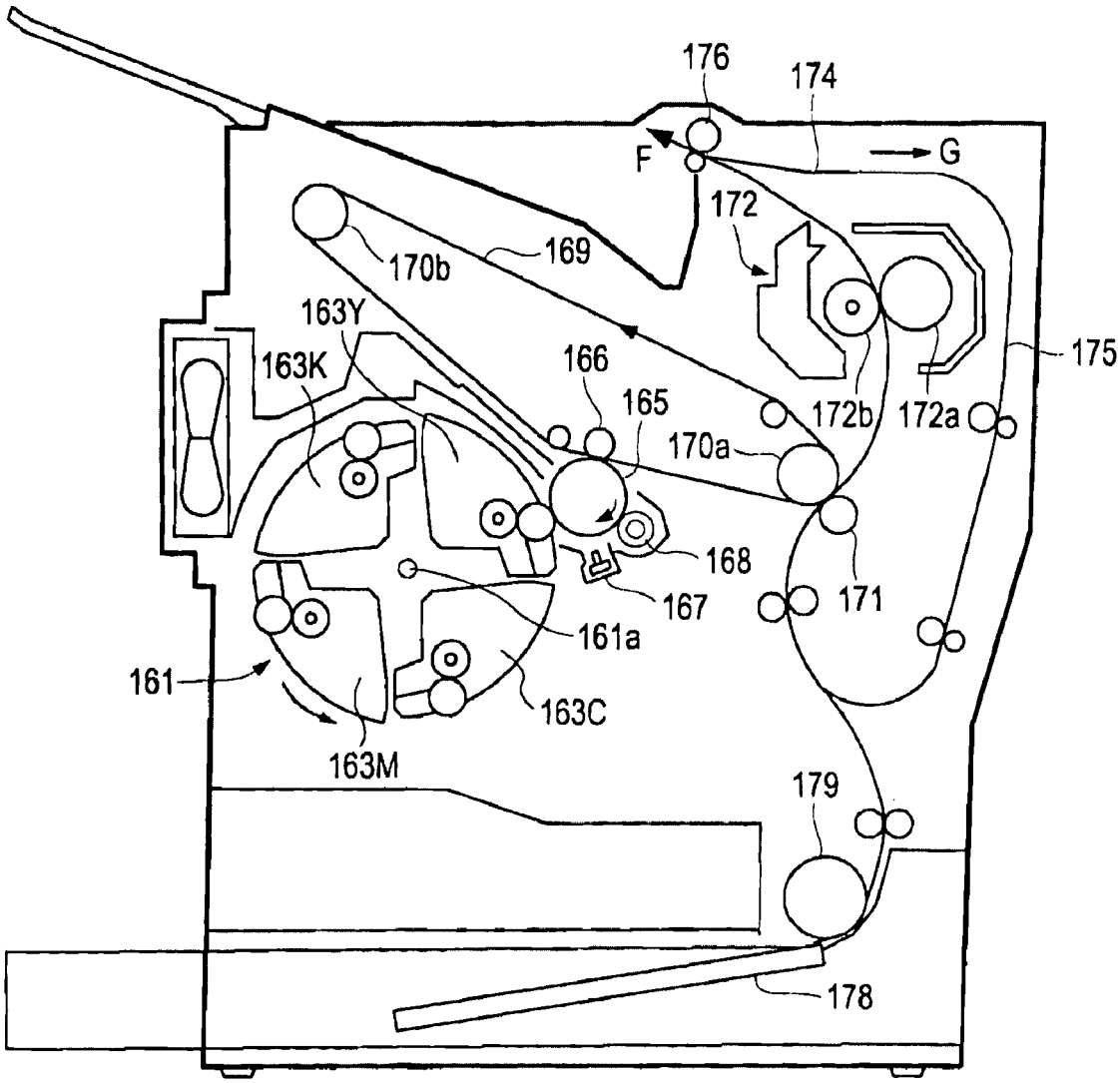
FIG. 17 is a longitudinal sectional view showing a configuration of another image forming apparatus using the optical head according to an embodiment of the invention.

FIG. 17 is a longitudinal sectional view of another image forming apparatus using the optical head 10A or 10B as a line type optical head. The shown image forming apparatus is a rotary development type full color image forming apparatus using a belt intermediate transfer body system. In the image forming apparatus shown in FIG. 17, a corona charger 168, a rotary development unit 161, an organic EL array 167 and an intermediate transfer belt 169 are disposed around a photoconductive drum 165.

The corona charger 168 charges the circumference of the photoconductive drum 165 uniformly. The organic EL array 167 forms an electrostatic latent image on the charged circumference of the photoconductive drum 165. The organic EL array 167 is the optical head 10A or 10B and is installed such that an arrangement direction of a plurality of light emitting devices P lies along a parent line (main scanning direction) of the photoconductive drum 165. The electrostatic latent image is formed by irradiating the photoconductive drum 165 with light emitted from the plurality of light emitting devices P.

The developing unit 161 is a drum having four developing devices 163Y, 163C, 163M and 163K disposed with an angular interval of 90° therebetween and can be rotated counterclockwise around an axis 161*a*. The developing devices 163Y, 163C, 163M and 163K supply yellow, cyan, magenta and black toner to the photoconductive drum 165, respectively, to develop the photoconductive drum 165 (that is, form a visible image) by attaching the toner as developer to the electrostatic latent image.

The endless intermediate transfer belt 169 is wound on a driving roller 170*a*, a driven roller 170*b*, a primary transfer roller 166 and a tension roller and is revolved around these rollers in a direction indicated by an arrow. The primary transfer roller 166 transfers the development into the intermediate transfer belt 169 passing between the photoconductor drum and the primary transfer roller 169 by electrostatically absorbing the development from the photoconductive drum 165.

Specifically, with the first one rotation of the photoconductive drum 165, the organic EL array 167 forms an electrostatic latent image for a yellow (Y) image on the photoconductive drum 165, the developing device 163Y forms the yellow development, and the yellow development is transferred into the intermediate transfer belt 169. In addition, with the next one rotation of the photoconductive drum 165, the organic EL array 167 forms an electrostatic latent image for a cyan (C) image on the photoconductive drum 165, the developing device 163C forms the cyan development, and the cyan development is transferred into the intermediate transfer belt 169 to be superimposed on the yellow development. In this manner, during four rotations of the photoconductive drum 165, yellow, cyan, magenta and black developments are sequentially superimposed each other on the intermediate transfer belt 169, thereby forming a full color development on the intermediate transfer belt 169. If an image is to be formed on both sides of a sheet as an object on which the image is finally formed, the same color development of front and rear sides of the sheet is transferred into the intermediate transfer belt 169, and thereafter, the next color development of front and rear sides of the sheet is transferred into the intermediate transfer belt 169. In this manner, a full color development is obtained on the intermediate transfer belt 169.

The image forming apparatus is provided with a sheet transport path 174 through which sheets pass. The sheet are picked up one by one by a pickup roller 179, travel along the sheet transport path 174 by a transport roller, and pass through a nip between the intermediate transfer belt 169 contacting the driving roller 170*a* and a secondary transfer roller 171. The secondary transfer roller 171 transfers the full color development into one side of sheet by electrostatically absorbing the full color development from the intermediate transfer belt 169 collectively. The secondary transfer roller 171 becomes close to or distant from the intermediate transfer belt 169 by a clutch (not shown). When the full color development is transferred into the sheet, the secondary transfer roller 171 contacts the intermediate transfer roller 171. While the transfer of development into the intermediate transfer belt 169 continues, the intermediate transfer belt 169 is separated from the secondary transfer roller 171.

The sheet onto which the image is transferred is transported to a fixing unit 172, and the development on the sheet is fixed when the sheet passes between a heating roller 172*a* and a pressing roller 172*b* of the fixing unit 172. The sheet after the fixing treatment is led between a pair of sheet discharge rollers 176 and travels along an arrow F. In case of double-sided print, after the most part of the sheet passes through the pair of sheet discharge rollers 176, the pair of sheet discharge rollers 176 is reversely rotated, and the sheet is introduced into a double-sided print transport path 175 as indicated by an arrow G. Then, development is transferred into the other side of the sheet by the secondary transfer roller 171 and then is fixed by the fixing unit 172, and then the sheet is discharged to the pair of sheet discharge rollers 176.

Since the image forming apparatuses shown in FIGS. 16 and 17 use the light emitting devices P as an exposure means, it is possible to make the apparatuses smaller than those using a laser scan optical system. In addition, the optical head of the invention can be employed for electrophotography-based image forming apparatuses other than those described and shown in the above. For example, the optical head of the invention can be applied to image forming apparatuses of a type that development is directly transferred into a sheet from a photoconductive drum without using an intermediate transfer belt or image forming apparatuses that form a monochromatic image.

In addition, the optical head of the invention is not applied to only image forming apparatuses. For example, the optical head of the invention may be employed as illuminators used for various kinds of electronic apparatuses including, for example, a facsimile machine, a copy machine, a multifunction copier, a printer, etc. Optical heads having a plurality of light emitting devices arranged in the form of a plane may be adaptively employed for these electronic apparatuses.

The entire disclosure of Japanese Patent Application No: 2006-298561, filed Nov. 2, 2006 is expressly incorporated by reference herein.

What is claimed is:

1. An optical head that represents gray scales of an image by expressing gray scales of pixels, which belong to a block, with binary values, the block being constituted by n pixels (n is a natural number of 2 or more) in a first direction and m pixels (m is a natural number) in a second direction, comprising:

a plurality of light emitting devices that extend in the first direction and emit light with luminance in accordance with a driving current;

a plurality of driving transistors that are provided corresponding to the plurality of light emitting devices and that supply the driving current;

a potential line that applies a source potential or a gate potential to the plurality of driving transistors; and a plurality of driving circuits that are provided corresponding to the plurality of driving transistors and that supply a driving control signal to specify an ON state or an OFF state for gates of the driving transistors, wherein the driving circuits each includes:

a line having an intersection at which the line intersects the potential line; and a logic circuit that generates the driving control signal based on image data to instruct turning-on or turning-off of the light emitting devices, the line being included in the logic circuit and carrying the image data, and wherein the logic circuits of the plurality of driving circuits invert logic levels of the lines at the intersections every n natural number of intersections extending in the first direction corresponding to the block.

2. The optical head according to claim 1, wherein the plurality of driving circuits each include a first driving circuit that inverts the image data an odd number of times until the image data reaches the intersection and a second driving circuit that inverts the image data an even number of times until the image data reaches the intersection, and wherein the first driving circuits and the second driving circuits are alternately disposed every n natural number of intersections extending in the first direction corresponding to the block.

3. An exposure apparatus comprising:

an optical head according to claim 1; and a control circuit that generates image data representing gray scales of an image by expressing gray scales of pixels belonging to the block with binary values, and outputs the generated image data to the optical head.

4. An exposure apparatus comprising:

an optical head including a plurality of light emitting devices extending in a first direction; and a control circuit that supplies image data to instruct turning-on or turning-off of the light emitting devices to the optical head, wherein the control circuit generates the image data representing gray scales of an image by expressing gray scales of pixels, which belong to a block, with binary values, the block being constituted by n pixels (n is a natural number of 2 or more) in the first direction and m pixels (m is a natural number) in a second direction, wherein the optical head includes:

a plurality of driving transistors that supply a driving current to the plurality of light emitting devices;

a potential line that supplies a source potential or a gate potential to the plurality of driving transistors; and a plurality of driving circuits that are provided corresponding to the plurality of driving transistors and that supply a driving control signal to specify an ON state or an OFF state for gates of the driving transistors, wherein the driving circuits each include:

a line having an intersection at which the line intersects the potential line; and a logic circuit that generates the driving control signal based on the image data, the line being included in the logic circuit and carrying the image data, and wherein the control circuit generates the image data such that the logic circuits of the plurality of driving circuits invert logic levels of the lines at the intersections every n natural number of intersections extending in the first direction corresponding to the block.

5. The exposure apparatus according to claim 4, wherein the plurality of driving circuits each include a first driving circuit and a second driving circuit, wherein the first driving circuit includes a latch circuit that latches the image data, a first inverting circuit that inverts an output signal of the latch circuit, and a second inverting circuit that inverts an output signal of the first inverting circuit and outputs the driving control signal, and the line having the intersection at which the line intersects the potential line connects an output terminal of the first inverting circuit and an input terminal of the second inverting circuit, wherein the second driving circuit includes a latch circuit that latches the image data, and a first inverting circuit that inverts an output signal of the latch circuit and outputs the driving control signal, and the line having the intersection at which the line intersects the potential line connects an output terminal of the first inverting circuit and gates of the driving transistors, and wherein the first driving circuits and the second driving circuits are alternately disposed every n natural number of intersections extending in the first direction corresponding to the block.

6. An image forming apparatus comprising:

an exposure apparatus according to claim 3; and an image carrier on which an image is formed by light emitted from the optical head.

* * * * *